US006197125B1

(12) United States Patent
Kung

(10) Patent No.: US 6,197,125 B1
(45) Date of Patent: Mar. 6, 2001

(54) MODIFICATION OF DIFFUSION COATING GRAIN STRUCTURE BY NITRIDING

(75) Inventor: Steven C. Kung, Plain Township, Stark County, OH (US)

(73) Assignee: McDermott Technology, Inc., New Orleans, LA (US)

( * ) Notice: Subject to any disclaimer, the term of this patent is extended or adjusted under 35 U.S.C. 154(b) by 0 days.

(21) Appl. No.: 09/460,129

(22) Filed: Dec. 13, 1999

(51) Int. Cl.[7] ..... C23C 8/24

(52) U.S. Cl. ..... 148/220; 148/211; 148/219; 148/230; 148/232

(58) Field of Search ..... 148/211, 220, 148/219, 232, 230

(56) References Cited

U.S. PATENT DOCUMENTS 3,753,758 * 8/1973 Shanley ..... 117/25
4,469,532 * 9/1984 Nicolas ..... 148/635
4,481,264 * 11/1984 Faure ..... 428/627
5,372,655 * 12/1994 Preisser et al. ..... 148/230
5,595,610 * 1/1997 Maeda et al. ..... 148/233
5,648,178 * 7/1997 Heyse et al. ..... 428/627
5,707,460 * 1/1998 Chaterjee ..... 148/218
5,989,734 * 11/1999 Miura et al. ..... 428/656

* cited by examiner

*Primary Examiner*—Daniel J. Jenkins
*Assistant Examiner*—Nicole Coy
(74) *Attorney, Agent, or Firm*—R. J. Edwards; R. C. Baraona; Eric Marich

(57) ABSTRACT

A method for improving the corrosion resistance, increasing the hardness, providing superior ductility, and reducing surface-cracking of a diffusion coating by nitriding and heating-treating the diffusion coating is disclosed. The nitriding and heat-treating may occur subsequently or simultaneously. Further, the disclosed method may be practiced subsequent to or incorporated as an intergral part of any known diffusion coating process which utilizes a heating step in a furnace having a cover gas.

17 Claims, 1 Drawing Sheet

MODIFICATION OF DIFFUSION COATING GRAIN STRUCTURE BY NITRIDING

FIELD AND BACKGROUND OF THE INVENTION

The present invention relates generally to diffusion coating treatment for various metal workpieces, and more particularly to a new and improved method to modify the grain structure of a diffusion coated workpiece by a process involving nitriding.

In diffusion coating treatments of carbon and Cr—Mo steels, a phase transformation takes place from ferrite (a body-centered cubic structure) to austenite (a face-centered cubic structure) when the substrate is heated to typical diffusion coating temperatures. As the surfaces of the substrate are enriched with Cr (along with any other elements which may be present in the diffusion coating, including but not limited to Si and Al), the surface layer of the substrate is transformed back to ferrite at the coating temperatures while the alloy core remains as austenite. The resulting microstructure of the coating layer is always columnar (i.e., the grain boundaries have the same depth as the coating layer and form perpendicularly to the surface of the substrate) because directional solid-state diffusion is involved.

The nucleation rate of the coating is relatively slow compared to grain growth during diffusion coating, resulting in large columnar grains within the diffusion coating layer. After the coating treatment, the core of the coated parts transforms back to ferrite by means of nucleation and growth when the substrate cools from typical diffusion coating temperatures, whereas the coating layer itself undergoes no phase transformation during this time. Consequently, the ferritic surface of the coated workpiece (where the diffusion coating layer is created) retains a columnar grain structure.

Such a columnar grain structure makes the coated products susceptible to surface-induced cracking. Furthermore, the grain boundaries act as preferential sites for unwanted carbides to form, e.g., $M_{23}C_6$. Specifically, the precipitation of carbides at the columnar grain boundaries reduces the ductility of the coating and allows localized corrosion attack to take place (i.e., a corrosion mechanism sometimes referred to as "sensitization"). Another disadvantage of a columnar grain structure is that the large columnar grains may possess relatively low hardness, resulting in a soft surface on the coated parts.

Thus, columnar grain structure in diffusion coatings are suspectible to failures when used in various applications. Accordingly, efforts have been made to improve the diffusion coating performance by modifying the diffusion-coating microstructure from columnar to primarily equiaxed.

Heat treatment has been employed to modify the microstructure of alloys that possess different crystalline structures at different temperatures. For example, the crystalline structure of carbon and Cr—Mo steels can be transformed from face-center cube (fcc) to body-center cube (bcc) when the materials are cooled to below approximately 1674° F. (912° C.). As phase transformation occurs, the microstructure is altered via recrystallization and growth of the new phase in the alloy, thereby improving the mechanical properties of the steels. The hardness of an alloy can also be improved by tailoring the grain size of the new phase formed. Thus, an alloy that can be hardened simply by a heating cycle is often referred to as "hardenable."

However, some alloys, such as stainless steels and nickel-base alloys, possess the same crystalline structure throughout the entire temperature range of interest. As a result, no phase transformation can take place by varying the temperature alone. Instead, the implementation of cold working, followed by heat treatment, is necessary to alter the grain structure of these alloys. This group of alloys is classified as "non-hardenable."

Diffusion coatings produced on steels are non-hardenable. Therefore, the microstructures of such diffusion coatings can only be modified by a combination of cold working and heat treatment. However, the use of cold working is impractical for diffusion-coated parts because cold working is prone to damaging the coating and reducing its thickness, thereby defeating the intended purpose of the coating. Furthermore, the amount of cold working necessary to initiate recrystallization and growth in the coating layer often causes significant deformation to the coated parts, such that deformation of many coated components, including boiler tubes, makes them unusable and unacceptable for their intended purpose. With these limitations in mind, the traditional method to modify the grain structure of non-hardenable alloys cannot be directly applied to diffusion coatings. Consequently, development of an alternative grain-modifying process for diffusion coatings is needed.

SUMMARY OF THE INVENTION

The present invention is drawn to a method of modifiying the diffusion coating grain structure by a process involving nitriding. This unique method increases the hardness of the resulting diffusion coating layer, eliminates the undesirable decarburized layer found underneath previous, unmodified diffusion coating layers, and provides superior ductility and improved corrosion resistance in comparison to previous, non-nitrided diffusion coating methods.

One aspect of the invention comprises a method for modifying the grain structure of a diffusion coating comprising: providing a workpiece with a diffusion coating, nitriding the workpiece, and heat-treating the workpiece. Notably, the nitriding step may be accomplished by providing a nitrogen-rich environment, preferrably through the provision of nitrogen or ammonium gas, while heating the workpiece to be nitrided. Likewise, the heat-treating step may be accomplished by additionally heating the nitrided workpiece at a set temperature for a set period of time. Finally, the diffusion coating, nitriding, and heat-treating steps may be performed concurrently (so that the nitriding heating step and the heat-treating heating step are combined into a single heating step) or in any combination or sequence.

Another aspect of the invention is drawn to a method for applying a diffusion coating with an improved, modified grain structure comprising: applying any known diffusion coating method which utilizes a heating step within furnace having a cover gas to a workpiece and nitriding the workpiece within the same furnace, wherein the cover gas is altered to include nitrogen and wherein either the heating step required by the nitriding is combined and performed concurrently with the heating step required by the known diffusion coating method or the heating step required by nitriding is performed separately from (i.e., either prior to or subsequent to) the known diffusion coating method.

An object of the invention is drawn to converting the columnar grain structure of a diffusion coating to an equiaxed structure to increase the hardness of the resulting coating.

Another object of the invention is to enhance the corrosion resistance of the resulting diffusion coating, preferably through the creation of an equiaxed grain boundary.

A still further object of the invention is to reduce the susceptibility of resulting diffusion coating to surface-induced cracking.

A final object of the invention is to provide a method of treating a diffusion coating layer whereby the mechanical properties of the resulting diffusion coating are enhanced and improved through the elimination of the undesirable decarburized zone underneath the coating found in previous, non-nitrided diffusion coating methods.

The various features of novelty which characterize the invention are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWING

In the accompanying drawing, forming a part of this specification, and in which reference numerals shown in the drawings designate like or corresponding parts throughout the same.

DESCRIPTION OF THE PREFERRED EMBODIMENTS

Figure 1:
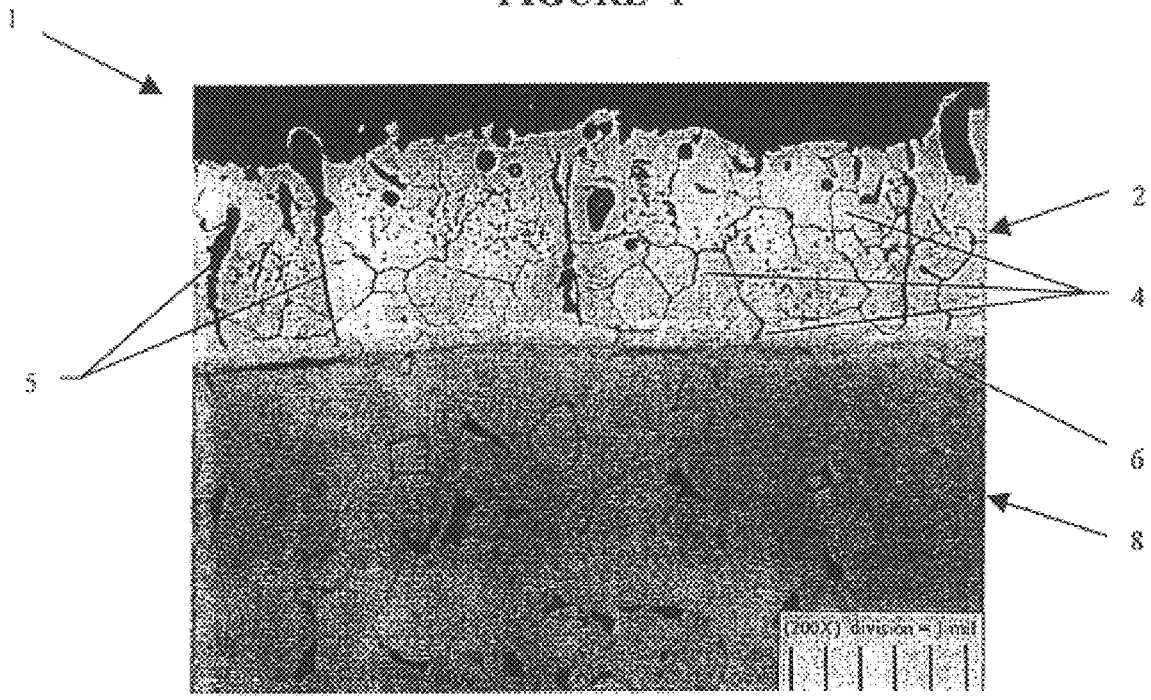
FIG. 1 is an optical micrograph of a workpiece treated according to the present invention, wherein a chromized stud was nitrided and subsequently heat treated in a nitrogen environment at 2012° F. for 1 hour.

This invention allows the diffusion-coating grain structure to be modified by nitriding. After the diffusion-coating treatment, the parts are nitrided, using any method known to those skilled in the art, at elevated temperatures for a definite period of time. Specifically, a nitrogen source, preferably in the form of nitrogen gas or ammonium, is introduced into the coating layer during this nitriding step at a temperature between 800–1100° F. Even a relatively small amount of nitrogen permits transformation of the ferritic coating layer to austenite at high temperatures because nitrogen is a strong austenite (fcc) stabilizer. Ultimately, the required nitriding time can be calculated based on the thickness of the diffusion coating, with a thicker coating layer requiring a longer nitriding time, and vice versa (such that the nitriding time is proportional to thickness squared ($t\ x^2$)).

After nitriding, the coated parts are heat-treated to initiate the desired phase transformation in the coating. This heat-treating is performed by heating the nitrided samples to a desired temperature (preferably 1650–2250° F.), holding at the temperature for a short period of time (no more than 6 hours), and cooling to room temperature. During this heat-treating, the phase of the coating layer transforms from ferrite to austenite at the processing temperature then back to ferrite during cooling. Consequently, the coating microstructure is altered by the thermal cycle via nucleation and growth. More plainly stated, the diffusion coating layer has become "hardenable" as a result of nitriding.

To demonstrate the ability of nitriding to modify the grain structure of diffusion coatings, several materials were tested. For example, straight chromizing on 1010 steel studs, with a dimension of 1.125" length×0.375" OD, were first chromized using a known blanket diffusion process. Following chromizing, the studs were sent to three commercial vendors for nitriding. Two standard nitriding processes, which expose the samples to ammonia at 970–975° F. for approximately 24 hours, and one proprietary nitriding process, involving exposure of the samples to an ammonia-containing gas mixture at 1050° F. for 24–30 hours, were individually performed on separate, similarly-chromized studs.

After nitriding, the samples were heated in a high-temperature furnace to 2012° F. (1100° C.) under slow-flowing argon in a steel retort for 1 hour. An as-chromized stud (i.e., without nitriding) was also included in this furnace run for comparison. To further simplify the process, nitrogen was used as the cover gas in the later furnace runs for the post-nitriding heat treatment while keeping the temperature the same.

In addition to the commercial nitriding processes above, a fourth nitriding procedure was developed. This procedure involved exposing the chromized studs to commercial-grade nitrogen gas in a retort heated to 2012° F. (1100° C.) for 6 hours. After the nitrogen exposure, the retort was air-cooled to room temperature. Some of the advantages of using nitrogen for nitriding include elimination of the need for ammonia as the nitrogen source and the efficient combination of nitriding and heat-treating into a single heating step (thereby reducing the costs and complexities associated with two separate heating steps). Furthermore, this nitriding process can be conveniently incorporated into the existing diffusion coating processes.

After the post-nitriding heat treatments, the stud samples were cross-sectioned, mounted, and polished. The cross-sections were then electrolytically etched to reveal the coating microstructures. Testing of the four separately nitrided and heat-treated studs revealed that a very desirable microstructure was produced in the diffusion-coating layer for each method, including the formation of small equiaxed grains.

Significantly, no microstructural change was found on the chromized stud that was not nitrided but went through the heating cycle. Therefore, nitriding and heat-treating (either concurrent or subsequent to one another) are integral elements of the present invention, as either of these steps by itself cannot modify the microstructure of diffusion coating.

FIG. 1 is a cross-sectional optical micrograph generally showing workpiece 1 according to the present invention. Workpiece 1 clearly shows diffusion coating layer 4, uncoated layer 8, and a distinct boundary 6 therebetween. Notably, the present invention eliminates the undesirable decarburized zone that ordinarily occurs proximate to boundary 6 that is inherent in many previous, non-nitrided diffusion coating methods.

The microstructure of diffusion coating layer 2 results from the nitriding and heat-treating steps and, more specifically, small equiaxed grains 4 can be clearly seen within diffusion coating layer 2. Although some of the original columnar grain boundaries 5 are still visible, they may be eliminated by optimizing the post-nitriding heat treating parameters, such as increasing the furnace temperature. It should be pointed out that, in order to reveal the fine equiaxed grains 4, the columnar grain boundaries 5 were intentionally overemphasized by the electrolytic etching used.

For exemplary techniques concerning diffusion coating methods, see U.S. Pat. No. 5,912,050 (assigned to McDermott Technology, Inc. and The Babcock & Wilcox Company, disclosing an improved method for chromizing small parts in a retort), U.S. Pat. No. 5,873,951 (disclosing a method for chromizing via thermal spraying), and U.S. Pat. No. 5,135,777 (assigned to The Babcock & Wilcox Company, disclosing a method for diffusion coating a workpiece with various metals including chromium by placing ceramic fibers next to the workpiece and by heating to diffuse the diffusion coating into the workpiece). All of these patents are incorporated by reference herein. For an exemplary technique for chromizing via thermal spraying, with the added option of including other elements (such as boron, aluminum, and silicon) to further enhance the properties of the resulting coating, refer to U.S. patent application Ser. No. 09/415,980, filed on Oct. 12, 1999, and entitled "Method for Increasing Fracture Toughness in Aluminum-Based Diffusion Coatings." Accordingly, U.S. patent Ser. No. 09/415,980 filed on Oct. 12, 1999, is incorporated by reference herein. Finally, those skilled in the art will appreciate and readily understand the various diffusion coating methods and nitriding methods currently available.

What is claimed is:

1. A method for modifying the grain structure of a diffusion coating comprising:

providing a workpiece having a diffusion coating layer including at least one of: chromium, aluminum and silicon and having a columnar grain structure and a defined thickness;

nitriding the workpiece; and heat-treating the workpiece to convert the columnar grain structure of the diffusion coating layer to an essentially equiaxed grain structure.

2. The method of claim 1, wherein the nitriding step comprises exposing the workpiece to a first selected temperature for a first selected period of time in the presence of at least one of: nitrogen and ammonium.

3. The method of claim 2, wherein the first selected temperature is between 800° F. and 1100° F.

4. The method of claim 2, wherein the first selected period of time is calculated based on the thickness of the diffusion coating.

5. The method of claim 1, wherein the heat-treating step comprises exposing the workpiece to a second selected temperature for a second selected period of time and subsequently allowing the workpiece to cool.

6. The method of claim 5, wherein the second selected temperature is between 1650° F. and 2250° F.

7. The method of claim 5, wherein the second selected period of time is less than 6 hours.

8. The method of claim 1, wherein the heat-treating step occurs subsequent to the nitriding step.

9. The method of claim 1, wherein the nitriding step and the heat-treating step are performed simultaneously.

10. A method for modifying the grain structure of a diffusion coating comprising:

providing a workpiece having a diffusion coating layer including at least one of: chromium, aluminum and silicon and having a columnar grain structure and a defined thickness;

exposing the workpiece to a first selected temperature for a first selected period of time in the presence of at least one of: nitrogen and ammonium; and exposing the workpiece to a second selected temperature for a second selected period of time and subsequently allowing the workpiece to cool so that the columnar grain structure of the diffusion coating layer is converted to an essentially equiaxed grain structure.

11. A method according to claim 10, wherein the first selected temperature is between 800° F. and 1100° F. and wherein the second selected temperature is between 1650° F. and 2250° F.

12. A method according to claim 11, wherein the first selected period of time is calculated based on the thickness of the diffusion coating and wherein the second selected period of time is less than 6 hours.

13. A method for applying a diffusion coating with a modified grain structure comprising:

applying a diffusion coating material including at least one of: chromium, aluminum and silicon to a workpiece;

placing the workpiece inside of a furnace having a cover gas;

heating the workpiece in a manner sufficient to diffuse the diffusion coating material into the workpiece;

altering the cover gas to include nitrogen in a manner sufficient to nitride the workpiece and in a manner sufficient to create an essentially equiaxed grain structure within the diffusion coating; and removing the workpiece from the furnace.

14. A method according to claim 13, further comprising adjusting the heating of the workpiece to a selected temperature for a selected period of time subsequent to the altering the cover gas step and prior to the removing the workpiece from the furnace step.

15. A method according to claim 14, wherein the cover gas consists essentially of nitrogen gas.

16. A method according to claim 13, wherein the altering the cover gas step occurs simultaneous with the heating the workpiece to diffuse the diffusion coating material step.

17. A method according to claim 16, wherein the selected temperature is between 1650° F. and 2250° F.

* * * * *